US009566499B2

(12) United States Patent
Sullivan

(10) Patent No.: US 9,566,499 B2
(45) Date of Patent: Feb. 14, 2017

(54) BINDING STRAP ASSIST MECHANISM WITH A TORSION SPRING

(71) Applicant: Daniel C. Sullivan, Santa Barbara, CA (US)

(72) Inventor: Daniel C. Sullivan, Santa Barbara, CA (US)

( * ) Notice: Subject to any disclaimer, the term of this patent is extended or adjusted under 35 U.S.C. 154(b) by 0 days.

(21) Appl. No.: 15/017,625

(22) Filed: Feb. 6, 2016

(65) Prior Publication Data

US 2016/0256766 A1 Sep. 8, 2016

Related U.S. Application Data

(63) Continuation-in-part of application No. 29/519,129, filed on Mar. 2, 2015.

(51) Int. Cl.
*A63C 9/18* (2012.01)
*A63C 10/04* (2012.01)

(52) U.S. Cl.
CPC ..... *A63C 10/04* (2013.01)

(58) Field of Classification Search
CPC ..... A63C 9/002; A63C 9/083; A63C 10/06
USPC ..... 280/619; 24/68 SK, 69 SK, 71 SK
See application file for complete search history.

(56) References Cited

U.S. PATENT DOCUMENTS 3,253,309 A * 5/1966 Baresch ..... B65D 63/16 24/170
5,172,454 A * 12/1992 Martignago ..... A43C 11/1406 24/68 SK
5,416,952 A * 5/1995 Dodge ..... A43C 11/00 24/68 A
5,606,779 A * 3/1997 Lu ..... A43C 11/146 24/68 SK
5,745,959 A * 5/1998 Dodge ..... A43C 11/00 24/68 SK
5,779,259 A * 7/1998 Lin ..... A43C 11/1413 24/68 SK
5,852,852 A * 12/1998 Rigal ..... A44B 11/14 24/170
5,887,318 A * 3/1999 Nicoletti ..... A43C 11/1413 24/68 SK
5,909,850 A * 6/1999 Cavasin ..... A43C 11/1413 24/70 SK
6,250,651 B1 * 6/2001 Reuss ..... A43C 11/1406 24/70 SK
6,412,794 B1 * 7/2002 Phillips ..... A43B 3/0073 280/14.22
6,554,297 B2 * 4/2003 Phillips ..... A43C 11/1413 24/68 SK (Continued)

*Primary Examiner* — Jeffrey J Restifo
(74) *Attorney, Agent, or Firm* — Kevin H. Fortin

(57) ABSTRACT

A binding strap assist mechanism. The binding strap assist mechanism can be retrofit onto standard snowboard binding straps to bias the binding straps and an open configuration. Binding straps pass through the binding strap assist mechanism so that tensile stress along the length of each of these binding straps during use is not significantly conveyed to the binding straps assist mechanism. The tensile stress are thus isolated to the binding straps which are intended to carry such stresses. The present invention provides a safe and convenient feature to snowboard bindings and other bindings. Safety is achieved because even if the binding strap assist mechanism breaks or fails to function, the binding straps will continue to function as normal.

15 Claims, 10 Drawing Sheets

(56) References Cited

U.S. PATENT DOCUMENTS 6,679,515 B2 * 1/2004 Carrasca ..... A63C 10/06 280/14.22
6,748,630 B2 * 6/2004 Livingston ..... A43C 11/1406 24/68 R
6,773,020 B2 * 8/2004 Gonthier ..... A63C 10/06 280/14.21
7,086,122 B2 * 8/2006 Livingston ..... A43C 11/1406 24/68 SK
7,237,793 B2 * 7/2007 Messmer ..... A63C 10/04 280/14.22
7,516,976 B2 * 4/2009 Cunningham ..... A43C 11/146 280/11.36
8,267,421 B2 * 9/2012 Krenn ..... A63C 10/06 280/619
8,579,318 B2 * 11/2013 Hall ..... A63C 10/045 280/617
8,763,209 B2 * 7/2014 Kavarsky ..... A43C 11/1413 24/68 SK
9,155,359 B1 * 10/2015 Bailey ..... A44B 11/065
9,332,798 B2 * 5/2016 Gafforio ..... A42B 3/08
2002/0089151 A1 * 7/2002 Carrasca ..... A63C 10/06 280/617
2003/0009918 A1 * 1/2003 Haupt ..... A43C 11/1413 36/50.5
2003/0019081 A1 * 1/2003 Livingston ..... A43C 11/1406 24/68 R
2003/0034634 A1 * 2/2003 Gonthier ..... A63C 10/06 280/623
2003/0127832 A1 * 7/2003 Couderc ..... A63C 10/285 280/613
2003/0201623 A1 * 10/2003 Pascal ..... A63C 10/06 280/623
2003/0201624 A1 * 10/2003 Pascal ..... A63C 10/04 280/623
2005/0057009 A1 * 3/2005 Couderc ..... A63C 10/04 280/11.36
2006/0175802 A1 * 8/2006 Maravetz ..... A63C 10/04 280/619
2007/0007750 A1 * 1/2007 Pascal ..... A63C 10/04 280/619
2007/0096411 A1 * 5/2007 Rempe, II ..... A63C 10/04 280/32.5
2007/0102900 A1 * 5/2007 Cunningham ..... A43C 11/1466 280/619
2007/0246914 A1 * 10/2007 Neiley ..... A63C 10/06 280/624
2010/0162539 A1 * 7/2010 Rancon ..... A43C 11/1453 24/70 ST
2010/0253045 A1 * 10/2010 Fumagalli ..... A63C 10/06 280/619
2010/0295269 A1 * 11/2010 Krenn ..... A63C 10/06 280/633
2012/0054989 A1 * 3/2012 Eisinger ..... B60N 2/2812 24/168
2012/0297591 A1 * 11/2012 Bozzetto ..... A43C 11/146 24/68 SK
2013/0031702 A1 * 2/2013 Gafforio ..... A42B 3/08 2/421
2013/0047388 A1 * 2/2013 Kavarsky ..... A43C 11/1413 24/68 SK
2013/0186216 A1 * 7/2013 Adamczewski ..... A63C 10/16 74/89.23
2015/0375088 A1 * 12/2015 Rancon ..... A63C 10/08 280/619
2016/0256766 A1 * 9/2016 Sullivan ..... A63C 10/04

* cited by examiner

BINDING STRAP ASSIST MECHANISM WITH A TORSION SPRING

CROSS-REFERENCE TO RELATED APPLICATIONS

This patent application is a continuation-in-part of co-pending U.S. Design patent application No. 29519129, filed 2 Mar. 2015, the disclosure of which is incorporated herein by reference.

FIELD OF THE INVENTION

The present invention pertains to binding strap mechanisms, and particularly to snow board binding strap mechanisms that ease securing a foot into a binding.

BACKGROUND OF THE INVENTION

Snowboard bindings secure a snowboarder's foot onto his or her snowboard. Current bindings are effective during snowboarding, but still cumbersome to bind to a foot.

Snowboard binding need to be removed often, unlike ski bindings. This is because of the nature of most chair lifts. Upon boarding a chair lift, one foot needs to be removed from the snow board binding and reattached after exiting the chairlift. The reattachment of the one foot into the binding is preferably done rapidly and efficiently. Upon chairlift egress, the snowboarder typically slides down a slope with one foot bound and one free. The snowboarder must stop to re-attach the binding prior to commencing further down-hill travel.

Difficulty is found when the snow board binding strap overlays and area where the foot is to be inserted. This requires the snowboarder to bend over and physically remove the binding strap then insert the foot. This may sound simple, but when one is wearing bulky snow pants and a thick jacket, bending is not easy. On a slippery snow-covered hill there may be movement of the snowboard down the hill during this process. Accordingly it takes a special degree of skill to efficiently move the binding strap from the foot area, insert the foot into the binding while bent over, and to attach the binding strap. Both novices and experienced boarders recognize the cumbersome nature of re-attaching the binding every time a chairlift is used.

U.S. Pat. No. 6,679,515 B2 to Carrasca discloses a mechanism that helps the binding strap sets to more likely be free from the foot area. In particular, each binding strap set includes two sides. One side has a buckle and another side has ribs that engage the buckle. A hinge attaches the side with the buckle to the snowboard binding. The hinge enables the one side of the binding strap to flay open and thus enable the foot to be placed into the foot area of the binding.

While this represents a step forward in the art of binding straps, several drawbacks of this design are apparent. In particular there is a possibility when the binding strap is open such as during an exit from the chairlift that it could interfere with stability of the snowboard. There is also a possibility that the hinged side of the binding strap could flop inwards and cover the foot area thus providing little benefit to a snowboarder that must bend over and remove the strap from the foot area. A third drawback is that the hinge is in line with the strap. Every time the strap is tightened stress is endured by the hinge this creates a situation where either failure of the hinge is possible or very robust hinges are required.

U.S. Pat. No. 7,487,992 B2 to Pascal et al. discloses a pivoting binding strap hinge that biases a snowboard strap into the open position. While the pivoting binding strap hinge performs multiple functions, it also suffers from the drawback that the pivot mechanism and biasing mechanism are in line with the strap. This causes the mechanisms to endure stress applied by the strap.

U.S. Pat. No. 8,597,318 B2 to Hall discloses a strap design for snowboard bindings. Each strap is bifurcated with materials of varying thicknesses to enable the strap to naturally bias into an open position. This also represents a step forward in the art of snowboard bindings however, there are drawbacks. One limitation is that the width of the binding strap near where it's mounted to the snowboard binding is much greater than the width of a normal strap. This is cumbersome.

What is desired is a better way to bias a snowboard binding strap into an open position. It is also desired is a way of biasing the snowboard binding strap into an open position which is reliable, not cumbersome, and that can retrofit on existing snowboard straps.

SUMMARY OF THE INVENTION

The present invention includes a snowboard binding. The bindings have binding straps. The binding straps include binding strap assist mechanisms to bias the binding straps into an open position which enables a snowboard user to easily place his or her foot into a foot area of the binding. The bindings are then buckled and secured to maintain a snowboarder's foot in the bindings.

Biasing the binding straps and open configuration provides convenience and enables haste. The present invention is safe and even if the binding strap assist mechanism breaks or otherwise fails the binding straps continue to operate unhindered.

Two variations of the binding strap assist mechanism are disclosed one including a compression spring which generates power through axial compression and extension of the spring the compression spring is a helical spring. The other variation includes torsion spring which generates power from rotation of the spring about its axis.

In both embodiments provide the advantage of having a binding strap pass through each binding strap assist mechanism. The binding strap carries the tensile force necessary to hold a foot in the binding. The binding strap assist mechanism does not need to bear this tensile force.

The embodiment having the compression spring is advantageous because during use of the snowboard, the compression springs are compressed to limit the entry of particulate matter between the compression spring windings.

Additionally when the snowboard binding straps are released from a closed configuration to an open configuration the interstitial space between the compression spring windings expands releasing any particulate matter that could've been trapped between the coils of the compression spring.

Similarly, in the embodiment utilizing torsion spring the interstitial spaces between the coils of the torsion spring can be minimized when the binding straps are holding a foot during operation to inhibit accumulation of particulate matter. The interstitial space between spring windings is maximized when the binding straps move to the open configuration to release accumulated particulate matter such as ice or snow when the binding straps release the foot.

Accordingly the present invention provides a reliable, simple, lightweight and safe mechanism for assisting binding straps of the snowboard into an open configuration. This makes the present invention convenient to use.

In each embodiment the binding strap passes through the binding strap assist mechanism. This is a distinctive attribute of the present invention that enables the binding straps to bear the tensile load to firmly hold a foot in a binding.

DETAILED DESCRIPTION

Figure 1:
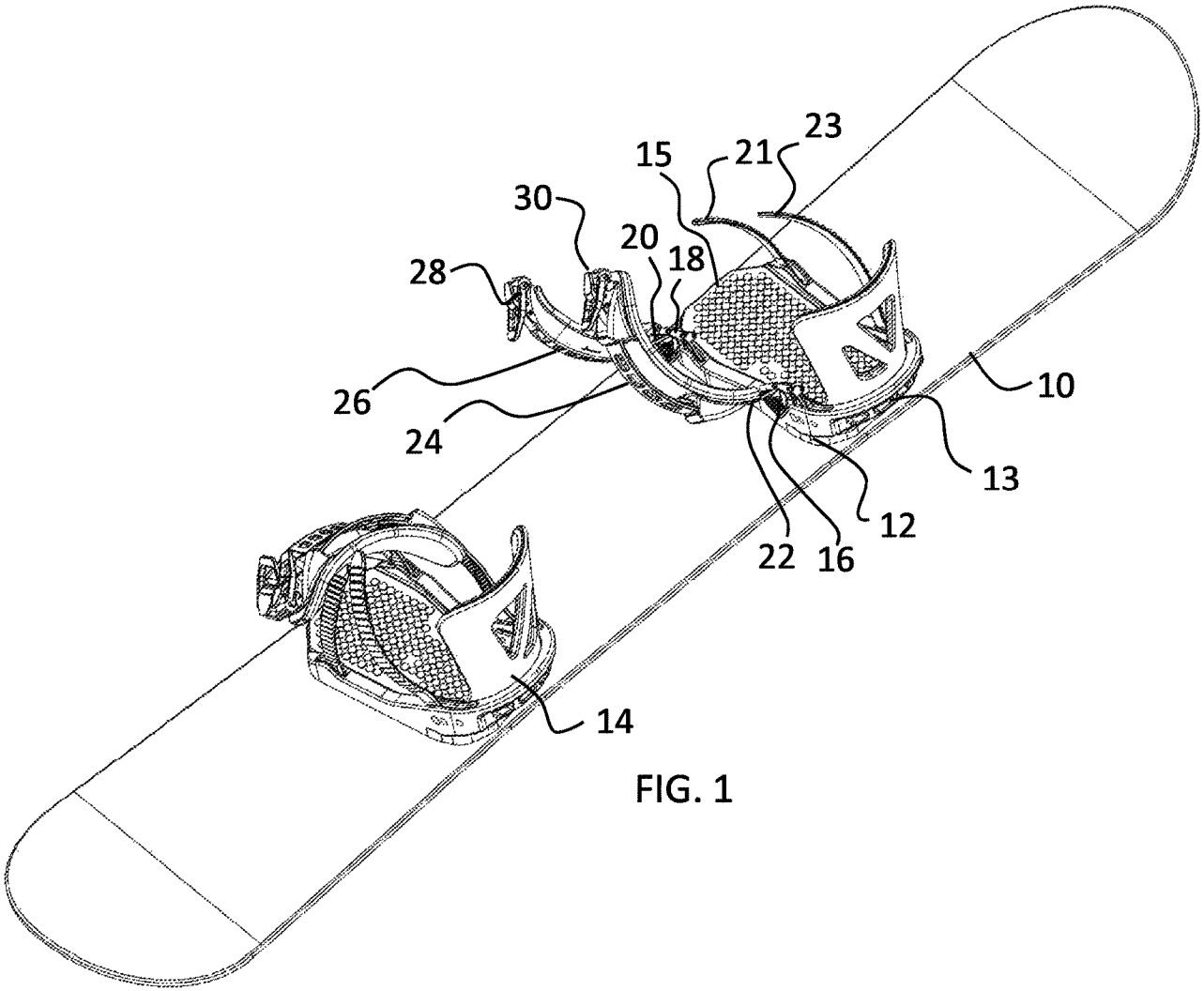
FIG. 1 is a perspective view of a snowboard including two bindings in accordance with the present invention.

FIG. 1 shows a snowboard generally designated with the reference numeral 10. The snowboard includes binding 12 and binding 14 mounted on the snowboard. The binding 12 includes a heel cup 13, a foot area 15, a proximal pair of binding straps, and a distal pair of binding straps. The proximal pair includes binding strap 22 having one end attached proximal to the heel cup 13 and the binding strap 23 having one end attached proximal to the heel cup 13. The distal pair of binding straps includes binding strap 20 and binding strap 21. The binding strap 20 attaches to the binding 12 in a position distal the heel cup 13. The binding strap 21 attaches in a position distal to heel cup 13.

The binding straps 20, 21, 22, and 23 are shown in an open position to enable the foot of a snowboarder to readily be placed in the foot area 15.

The binding straps 22 and 20 are positioned on the medial side of the binding 12. Both straps 20 and 22 are an open position. The straps 20 and 22 both include strap pads 24 and 26 that respectively pad and cover portions of the binding strap 22 and 20.

The binding straps 20 and 22 also include a clasp 28 and 30 respectively that are fixed on the pads 24 and 26, respectively, of the binding straps 20 and 22. The clasps 28 and 30 attached to a free ends of each respective pad 24 and 26 of the binding straps 20 and 22. The clasps 28 and 30 enable the binding straps 21 and 23 to adjustably mate with the binding straps 20 and 22, respectively.

The binding straps 20 and 22 are typically integrated to the strap pads 24 and 26, respectively though a fastener such as a bolt. The fastener is removable to enable disassembly of the binding straps 20 and 22. Disassembly of the binding straps 20 and 22 through use of the removable fastener enables the binding strap assist mechanism of the present invention to slide over each binding strap 20 and 22 into an operative position. The binding straps 20 and 22 are then re-assembled by fastening the strap pads 24 and 26 into an original position.

Although a bolt is shown as an example of a removable fastener, any removable fastener used in snow board binding straps can be used in accordance with the present invention.

Each binding strap 20 and 22 further includes a binding strap assist mechanism 18 and 16 attached in a pass through arrangement on each binding strap 20 and 22, respectively. The strap assist mechanisms 18 and 16 bias the binding straps in the open position as shown.

Figure 2:
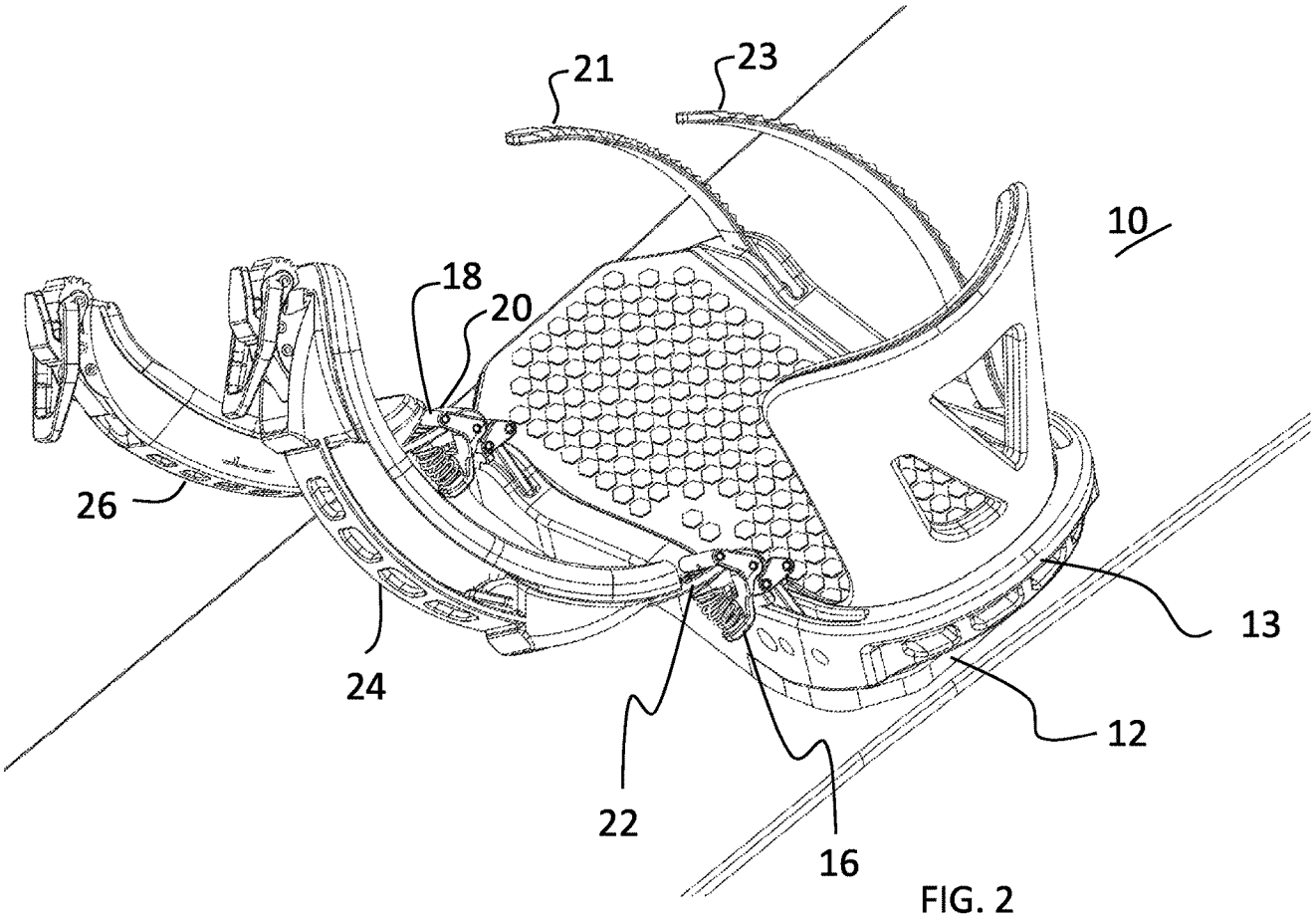
FIG. 2 is an enlarged perspective view of a binding mounted on the snowboard including a pair of binding strap assist mechanisms that maintain respective binding straps and an open position.

FIG. 2 shows an expanded view of the binding 12 on the snowboard 10. The binding strap 22 includes a bolted connection to the proximal portion of the binding 12 at the heel cup 13. The binding strap 20 has a fixed connection to the distal portion of the binding 12.

The binding strap 20 and 22 pass through the binding strap assist mechanisms 18 and 16, respectively. It can be appreciated that when the binding straps 20 and 22 connect with the binding straps 21 and 23 to hold the foot in the binding 12 that tensile stress along the length of each of these binding straps is significant and sufficient to hold the foot in the binding during rigorous snowboarding activity. This tensile stress is isolated to the binding straps and only insignificantly affects the binding strap assist mechanisms 18 and 16. This is because the pass-through connection does not require the binding strap assist mechanisms 18 and 16 to endure these tensile stresses. Accordingly, the pass-through connection isolates tensile stress applied to the binding straps 20 and 22.

An advantage of the present invention is that the binding strap assist mechanisms can retrofit on existing snowboard bindings by simply removing the binding pads 26 and 24 and slidably connecting the binding strap assist mechanisms 18 and 16, respectively into place. Once in place the binding pads 26 and 24 can be remounted to the snowboard binding 12. In this embodiment, there is no need to remove the binding straps 20 and 22 to make the present invention retrofitable on existing bindings without the need for tools in most instances.

An alternate embodiment the snowboard bindings 12 originally equipped with the snowboard binding strap assist mechanisms and sold as a single unit. The advantage of utilizing the binding strap assist mechanisms 18 and 16 is that standard binding straps 20 and 22 can be utilized, thus eliminating the need for custom binding straps to achieve the goals of the present invention.

In yet another embodiment snowboard 10 is sold with bindings 12 attached the bindings 12 include the binding strap assist mechanisms 18 and 16 on the binding straps 20 and 22, respectively. The advantage of this is that a snowboard customer can test the efficacy of the present invention while making a purchase decision.

Figure 3:
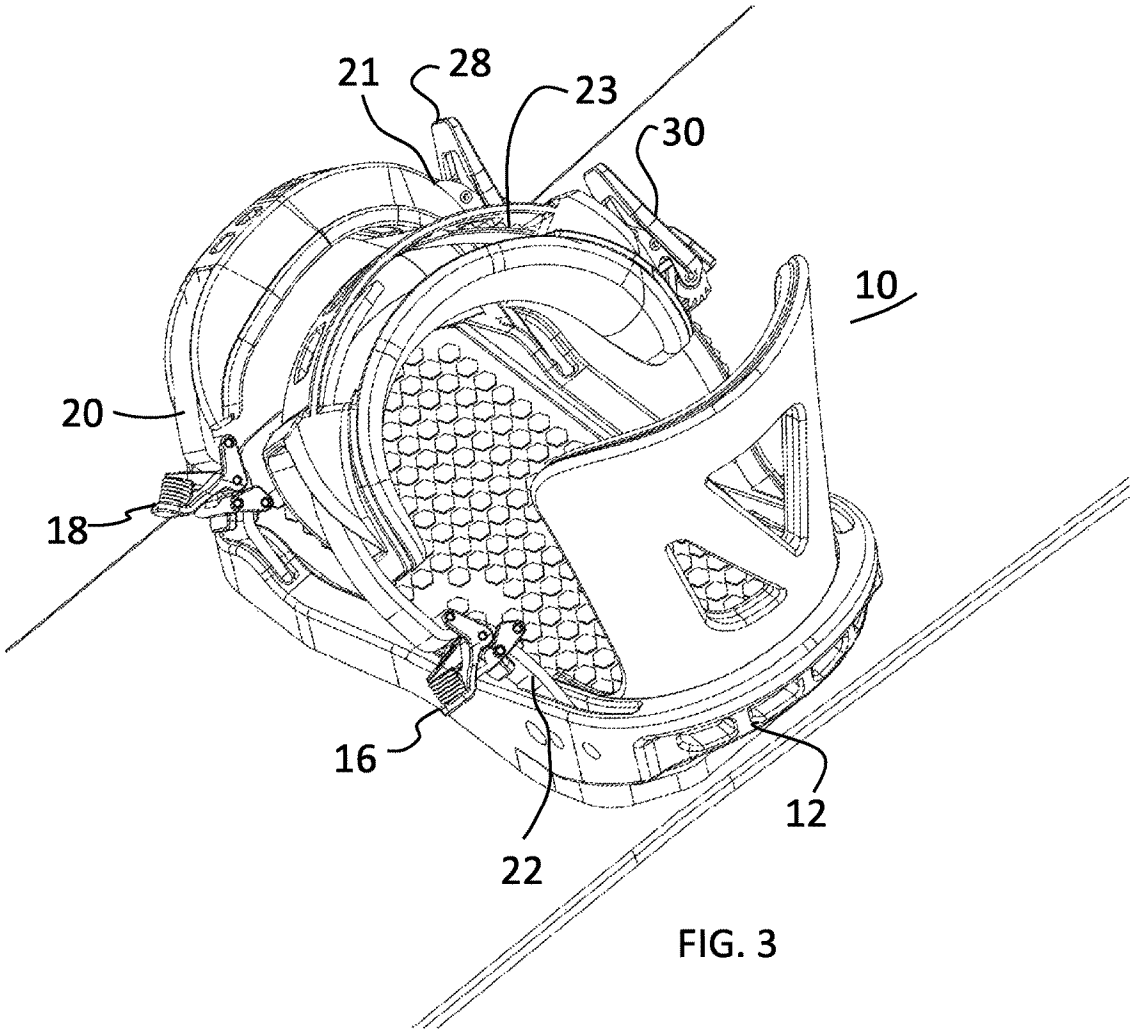
FIG. 3 is an enlarged perspective view of a binding strap mounted on a snowboard including a pair of binding strap assist mechanisms and the respective binding straps maintain a closed position

FIG. 3 shows the distal pair in the proximal pair of binding straps in the closed position. When the binding straps are in the closed position the binding straps cooperate to hold a snowboarder's foot in the binding 12. The binding strap assist mechanisms 18 and 16 endure very little pressure from the tension of the binding straps 20 and 22, respectively. The binding straps 20 and 22, which are designed for enduring significant tensile force, bear this tensile force without compromising the integrity or reliability of the binding strap assist mechanisms 18 and 16. This enables the binding strap assist mechanisms 16 and 18 to be designed in a way that is not bulky or cumbersome and also enables the binding strap assist mechanisms 16 and 18 to be highly reliable and durable.

The binding straps 21 and 23 include grooves or teeth that adjustably slide into the latches (e.g. 28) of the respective binding straps 20 and 22.

Figure 4:
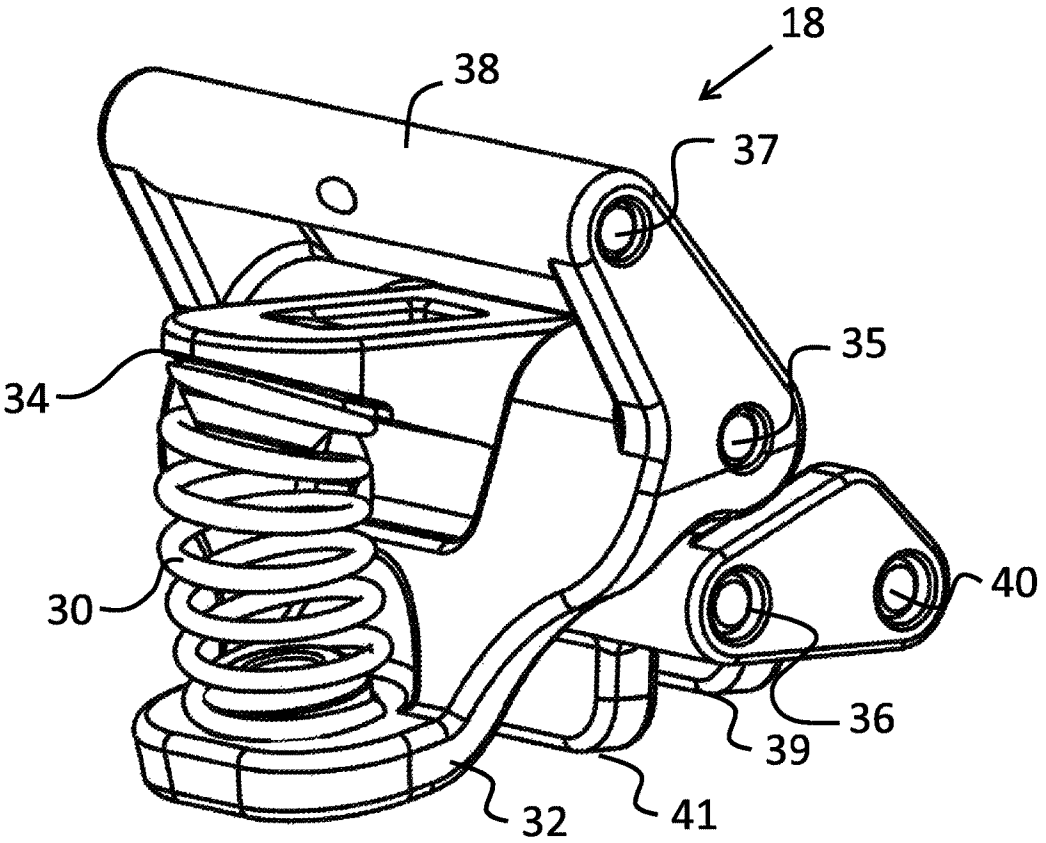
FIG. 4 is a perspective view of a binding strap assist mechanism in accordance with the present invention.

FIG. 4 shows a binding strap assist mechanism generally designated with the reference numeral 18. The binding strap assist mechanism 18 included a compression spring 30 having two ends, a lever arm 32 and a lever arm 34 that contact respective ends of the compression spring 30. The lever arm 34 and the lever arm 32 are connected to each other by a hinge 35 to enable relative movement of the lever arm 34 and the lever arm 32. This relative movement compress and release the compression spring 30.

The lever arm 32 and the lever arm 34 cooperate with the hinge 35 to form a buckle that holds the binding strap assist mechanism on a binding strap with friction.

The lever arm 32 is has a smooth end 38 for contacting the binding strap. The lever arm 34 includes a pin 40 contacting the binding strap. And the hinge 35 includes a smooth portion for contacting the binding strap. Together the smooth end 38, the pin 40 and the hinge 35 cooperate to hold the binding strap assist mechanism 18 in a desired position on the binding strap.

The lever arm 34 includes a reinforcement pin 36. The smooth end 38 of the lever arm 32 includes a reinforcement pin 37. The reinforcement pins assure that contact between a binding strap and the mechanism 18, does not deform the mechanism 18 due to contact between the binding strap and the regions of the mechanism 18 surrounding the reinforcement pins.

Manipulation of the lever arm 32 with respect to the lever arm 34 about the hinge 35 enable selective adjustment of the position of a binding strap assist mechanism 18 on a binding strap. Once manipulated into a desired position on a binding strap the cooperation of the smooth end 38, the pin 40 and the hinge 35 hold the binding strap assist mechanism 18 in the desired position.

The lever arm 34 includes constraint tabs 39 and 41 which are affixed to extend from the lever arm 34 in a position adjacent to pins 36 and 40. The constraint tabs inhibit undesired movement of the mechanism 18 on a binding strap while distancing the mechanism away from a binding strap to optimize moment forces that move the binding strap to an open configuration. The constraint tabs 39 and 41 assure optimal alignment of the mechanism 18 on a binding strap.

Figure 5:
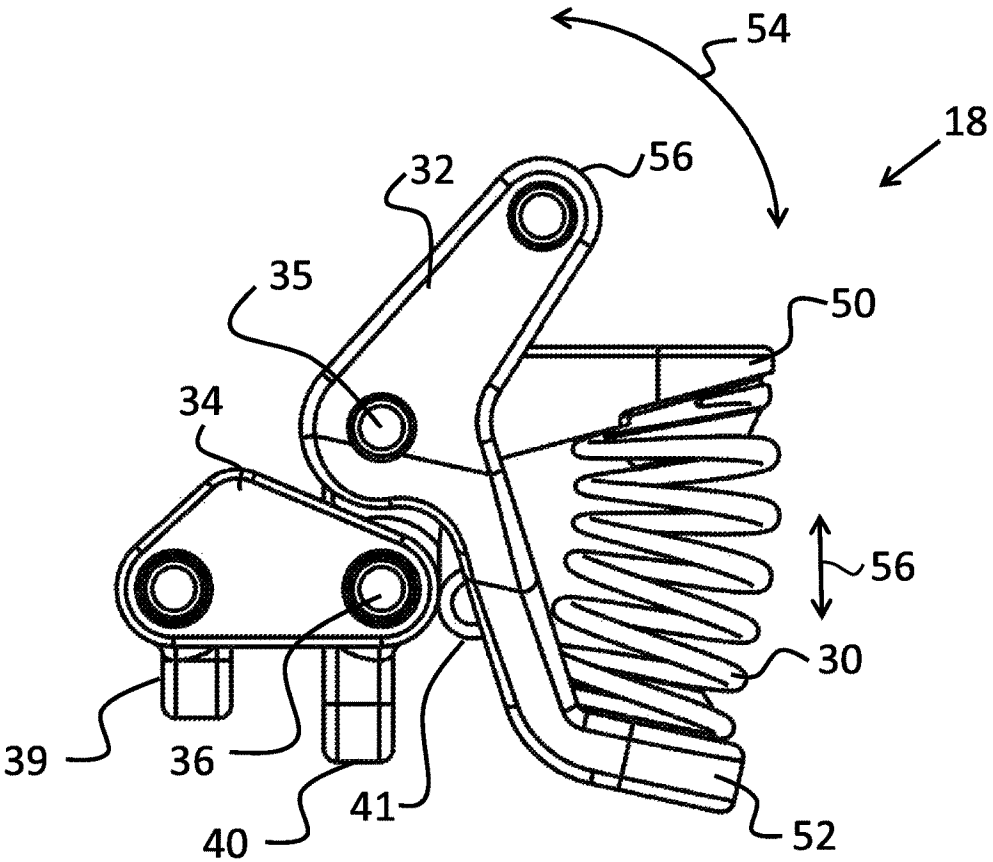
FIG. 5 is a side view of the binding strap assist mechanism of FIG. 4.

FIG. 5 shows a side view of the binding strap assist mechanism 18 of FIG. 4. The relationship between the lever arm 34 and the lever arm 32 with respect to the hinge 35 is clearly seen. Relative movement between the lever arm 32 and the lever arm 34 about the hinge 35 moves the end 56 of the lever arm 32 along an arc represented by the arrow 54. The lever arm 32 includes hinge stop 41. The hinge stop 41 is a fixed nib that is semi-spherical in shape, or semi-cylindrical in shape to inhibit build up of particulate matter such as ice or snow. The hinge stop 41 limits movement of the lever arm 32 with respect to the lever arm 34 when the spring 30 is extended and the mechanism 18 is in the open configuration as shown.

The lever arm 32 has an end 52 in contact with the compression spring 30. The lever arm 34 has an end 50 in direct contact with an opposite end of the compression spring 30. Relative movement between the lever arm 34 and the lever arm 32 in rotation about the hinge 35 compresses and extends the compression spring 30 in the directions of the arrows 56. It is shown that the ends 50 and 52 of the lever arms 32 and 34, respectively are angled slightly from each other, i.e. they are not axially aligned with each other. This assures that the spring 30 buckles slightly forming a curved axis. Buckling enables the spring 30 to apply energy both from axial extension and compression, but also from the buckling of the spring. Utilizing both compressive energy storage and energy storage yielded from buckling, the spring can apply more force against the mechanism 18 than would be possible through use of axial compressive forces only.

Figure 6:
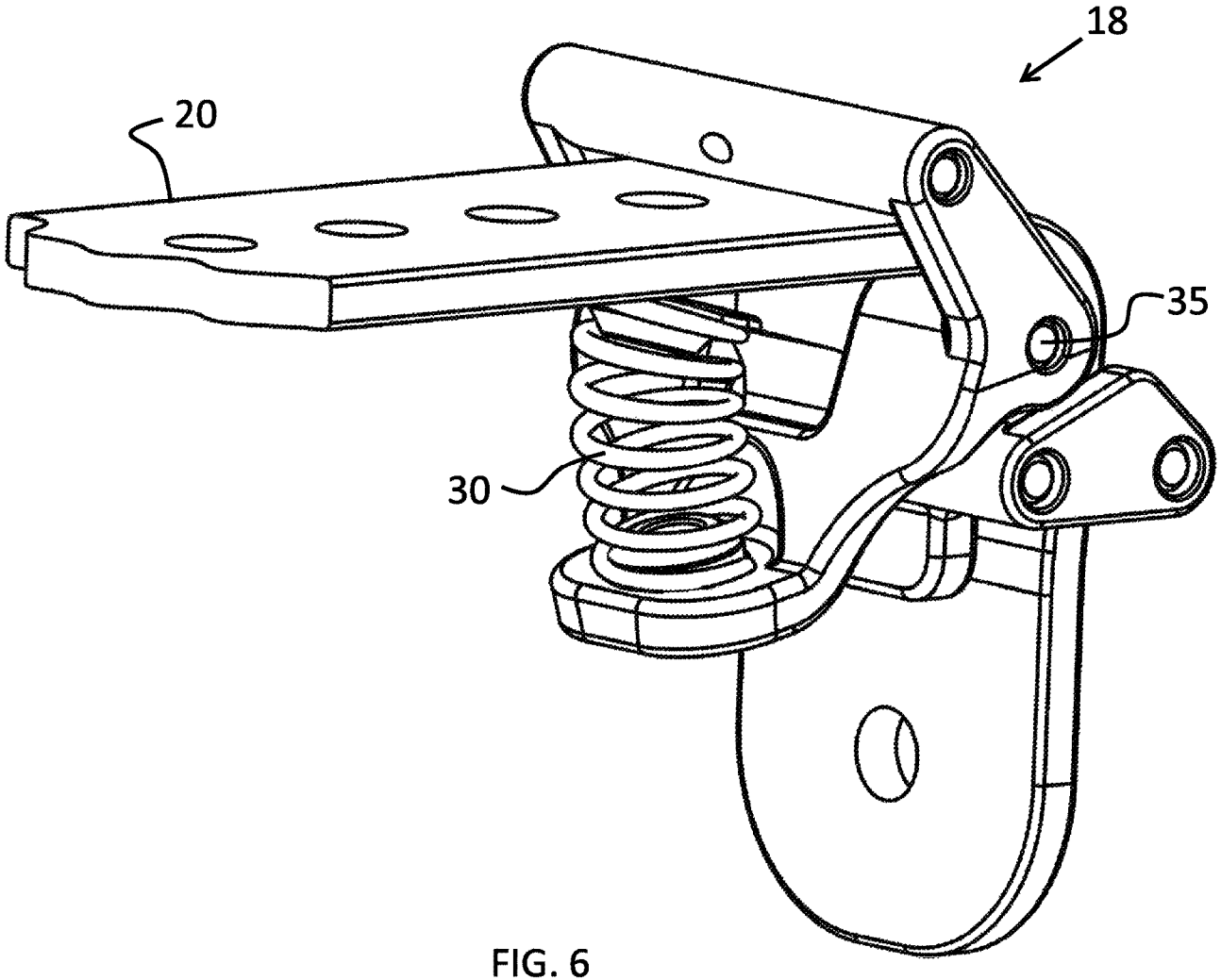
FIG. 6 is a perspective view of the binding strap assist mechanism of FIG. 4 including a binding strap oriented in an open position.

FIG. 6 shows the binding strap assist mechanism 18 biasing the binding strap 20 in the open position. Interstitial space between spring windings is maximized to release particulate matter such as ice and snow from the spring 30. The compression spring 30 is slightly buckled. The compression spring has an axis that has a curve when buckled.

Figure 7:
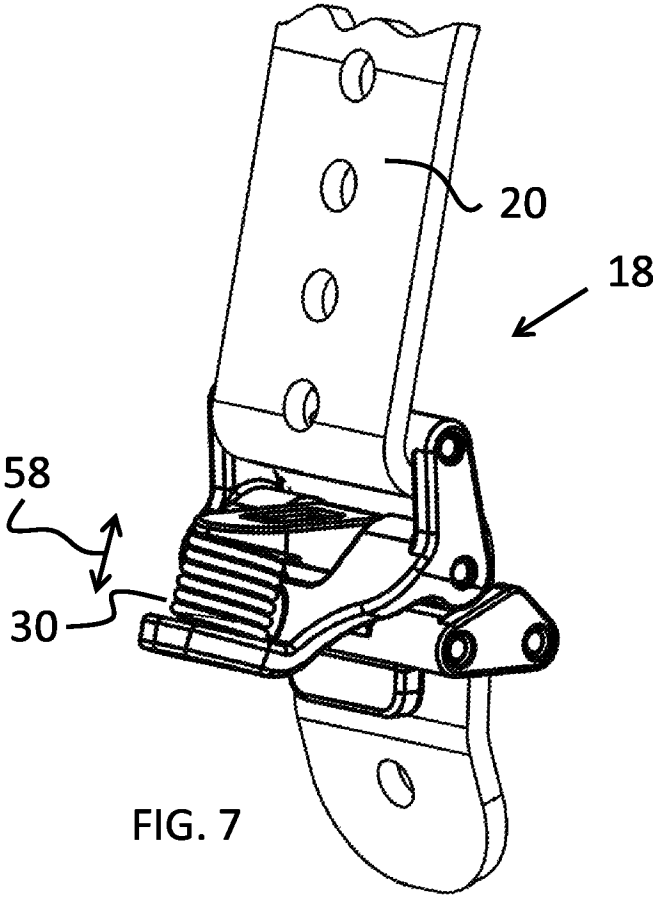
FIG. 7 is a perspective view of the binding strap assist mechanism of FIG. 4 including a binding strap oriented in a closed position

FIG. 7 shows the binding strap assist mechanism 18 holding a binding strap 20 and a closed position. Interstitial space between spring windings is minimized to inhibit entry of particulate matter into the spring 30.

In the closed position the compression spring 30 is nearly fully compressed to optimize axial extension capability of the compression spring and to minimize interstitial space between the windings of the compression spring 30. Minimizing interstitial space between the windings of the compression spring minimizes the buildup of ice and snow or other disruptive particulate matter in the compression spring. Accordingly during use the compression spring 30 is less likely to become bound with particulate matter such as ice, dirt and snow.

Additionally operation of the compression spring 30 between the closed position is shown to an open position (FIG. 6) applies axial force in the direction of the arrows 58 (extension). During extension of the compression spring, the compression spring releases any particulate matter attached to the compression spring 30. This is because when the binding strap assist mechanism 18 opens the interstitial space between spring windings is increased to release any particulate matter.

Accordingly operating a snowboard while utilizing the present invention for downhill travel when the compression spring closed position has the dual benefit of inhibiting buildup of particulate matter surrounding the coils of the compression spring by minimizing interstitial space between the spring windings during operation, and upon releasing the binding straps into the open position to increase such interstitial space and thereby release any built-up particulate matter.

The invention includes a method of attaching a binding strap assist mechanism to a snow board binding. The binding has straps that attach to hold a foot in the binding. Preparing the binding for attachment to a foot includes providing a binding strap having an integrated strap pad with a clasp. The strap pad being removeably attached to the binding strap with a removeably fastener or other device. The fastener can include a self-fastening fabric, or a threaded fastener, for example. Next, the strap pad is removed from the binding strap to make room for step of fastening the present invention to the binding strap.

Next, the binding strap assist mechanism slides over the binding strap. The binding strap assist mechanism includes a first lever arm and a second lever arm connected by a hinge. The hinge defines a spring side with a spring and a strap side that contacts a portion of the binding strap. The hinge moves to accommodate the binding strap. When the binding strap assist mechanism is optimally positioned on the binding strap the strap pad is replaced on the binding strap.

The spring is a helical spring that initially extends axially when the binding strap assist mechanism is attached to the binding strap, and the helical spring compresses axially when the binding strap is utilized to hold a foot in a snowboard.

Another method in accordance with the present invention attaches a foot into a snow board binding that includes a binding strap and the mechanism of the present invention. First, a snow board with a binding having a binding strap is provided. The binding strap having a binding strap assist mechanism to hold the binding strap in an open configuration. The binding strap assist mechanism includes two lever arms attached by hinge. The binding strap passes one side of the hinge, a spring mounts on another side of the hinge to bias the binding strap in the open configuration. The foot is inserted into the binding while the binding strap is in the open configuration. The foot is secured in the binding by moving the binding strap into a closed configuration. The spring compresses when the binding strap is in the closed configuration to inhibit snow from interfering with operation of the spring. The spring does not buckle when compressed, or buckles an insignificant amount. In this way the spring exerts at least 99% of its force in an axial direction with respect to the axis of the spring.

The spring extends when the binding strap is in the open configuration to release snow from the spring, particularly between the helical windings of the spring.

In a preferred embodiment, the spring buckles slightly when extended to exert an axial force, and additionally a force due to the flexion (buckling) of the spring. This enables a spring of compact design to be used. This also maximizes the amount of energy the spring can apply in moving the binding strap into an open configuration to receive a foot.

Figure 8:
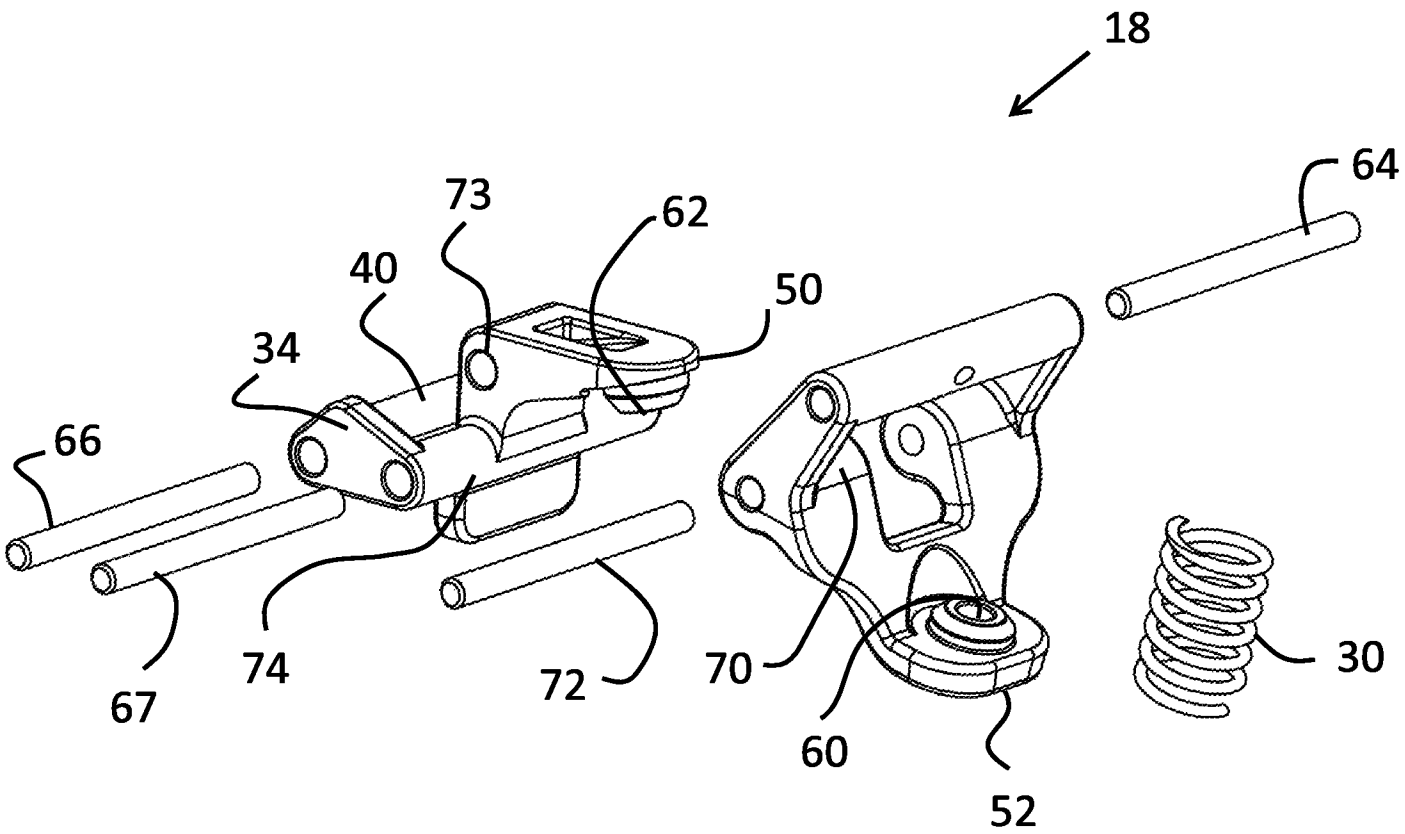
FIG. 8 is an exploded perspective view of the binding strap assist mechanism of FIG. 4.

FIG. 8 is an exploded view of the binding strap assist mechanism 18. The lever arm 34 and the lever arm 32 are hinged together. To enable relative movement of the lever arm 34 and the lever arm 32 compress and release the compression spring 30.

The hinged connection between the lever arm 34 and the lever arm 32 includes an axle 72 that press fits and extends through the smooth surfaces 70 and 68 of the lever arm 32. The lever arm 32 and the lever arm 34 cooperate to form a buckle that holds the binding strap assist mechanism 18 on a binding strap. The axle 72 also extends through a tube 73 defined on the lever arm 34.

The lever arm 32 is has a smooth end 38 for contacting the binding strap. The smooth end 38 is hollow for receiving a reinforcement bar 64 in a press fit arrangement. The reinforcement bar 64 improves the integrity and durability of the smooth end 38. The reinforcement bar 64 is made from stainless steel.

The lever arm 34 includes a smooth portion 40 for contacting a binding strap. The smooth portion 40 receives reinforcement bars 66 and 67 to improve the integrity and durability of the smooth portion 40. The reinforcement bars 64, 66 and 67 are made from stainless steel.

The cylinders 68 and 70 receive the hinge tube 73 of the lever arm 34 to form a portion of the hinge 35. The axle 72 inserts through the cylinders 68 and 70 and the hinge tube 73 of the lever arm 34 to hinge the lever arm 32 to the lever arm 34.

Figure 9:
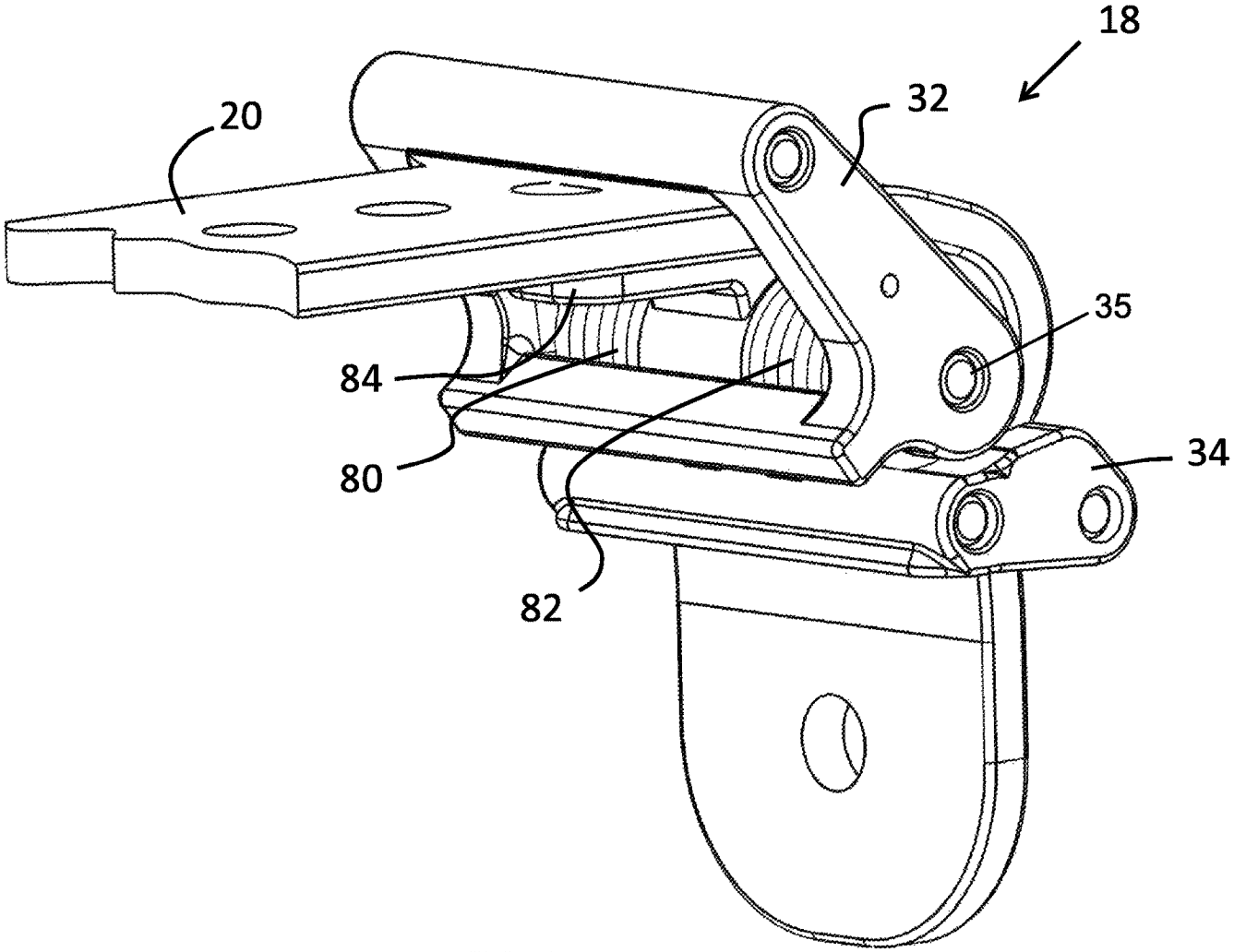
FIG. 9 is a perspective view of an alternate embodiment of a binding strap assist mechanism in accordance with the present invention oriented in an open position.

FIG. 9 shows an embodiment of the binding strap assist mechanism 18 in an open configuration. The binding strap assist mechanism 18 includes a lever arm 32 and a lever arm 34. A hinge 35 interconnects the lever arm 34 and the lever arm 32. Encircling the hinge are two helical torsion springs 80 and 82. The helical torsion springs circumscribe the hinge 35 in a helical pattern and bias the binding strap assist mechanism 18 in an open configuration as shown.

In an alternate embodiment, a single torsion spring can be used instead of the torsion springs 80 and 82. In another alternate embodiment, the two torsion springs can be replaced with a one double torsion spring.

The lever arm 34 includes an end having a strap support plate 84. The strap support plate 84 aligns the strap 20 and helps to prevent the strap 20 from contacting the ground beneath the snowboard when the binding strap assist mechanism 18 maintains an open configuration.

An advantage of this embodiment having the torsion spring design is that it is a low-profile and compact configuration that effectively biases a binding strap in an open configuration.

Figure 10:
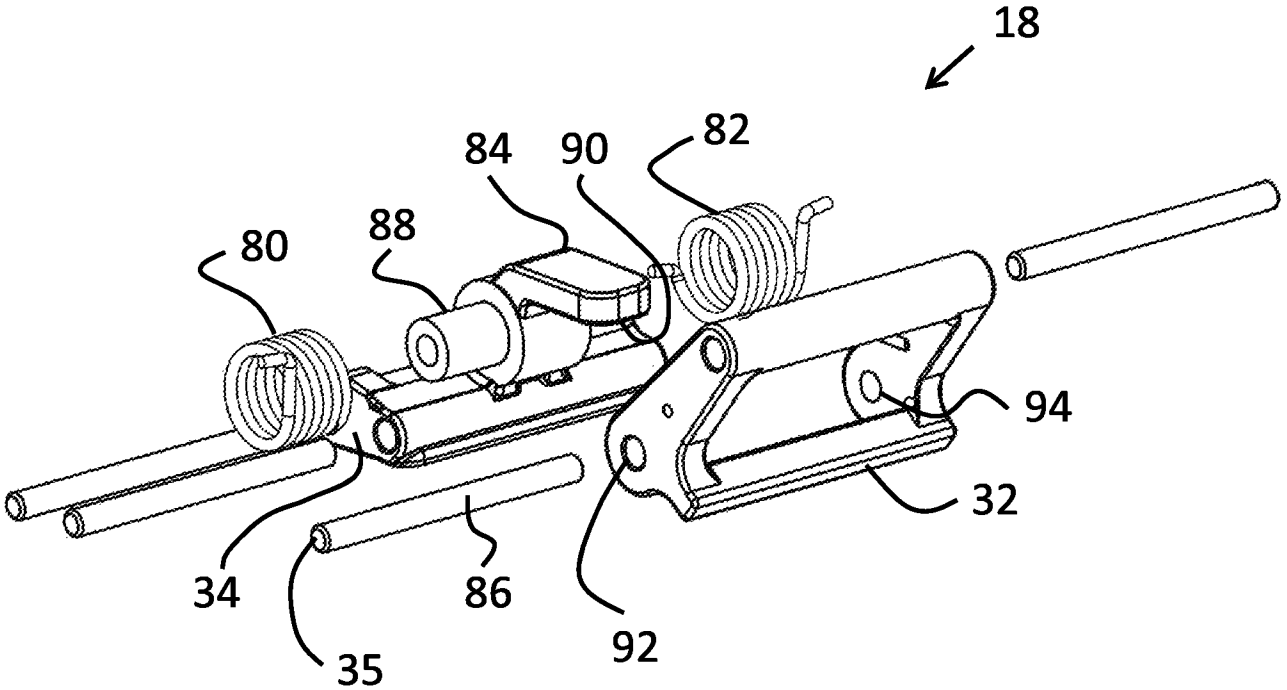
FIG. 10 is an exploded perspective view of the binding strap assist mechanism of FIG. 9.

FIG. 10 shows an exploded view of the binding strap assist mechanism 18 of FIG. 9. Hinge 35 includes an axle pin 86 and a pair of hubs 88 and 90. The hubs 88 and 90 are integral to the lever arm 34 and the strap support plate 84. Hubs 88 and 90 are hollow to enable the axle pin 86 to insert through the hubs 88 and 90. The lever arm 32 define openings 92 and 94 for receiving the axle pin 86 and holding the lever arm 34 with the lever arm 32 in hinged arrangement.

It can be appreciated that although the springs disclosed in the specification include compression and torsion springs having helically wound coils, the springs can also be made from any other material that stores energy when compressed or extended, or stores energy in response to torsion, and releases that energy in a manner similar to compression or torsion springs. Preferably the spring material would be able to endure temperatures of between −35° C. to 30° C. Additionally, the springs may include a cover to further achieve the goals of the invention. It can be further appreciated that the compression spring in various embodiments can also be replaced with multiple compression springs.

I claim:

1. A snowboard binding strap assist mechanism for biasing a binding strap into an open configuration, comprising:

a first binding strap, a second binding strap, and a clasp for mating said first and second binding straps in a closed configuration;

a first lever arm, a second lever arm and a hinge that attach in a pass through arrangement with the first binding strap, the hinge includes a torsion spring to cause the first and second lever arms to bias the first binding strap into the open configuration; and a strap support plate on the first lever arm to limit the first binding strap in the open configuration.

2. The snowboard binding strap assist mechanism as set forth in claim 1, wherein the first lever arm and the second lever arm each have an end, the end of the first lever arm and the end of the second lever arm receive the snow board binding strap in the pass through arrangement.

3. The snowboard binding strap assist mechanism as set forth in claim 1, wherein the hinge includes two torsion springs encircling the hinge.

4. The snowboard binding strap assist mechanism as set forth in claim 3, wherein the springs have helical coils defining interstitial space between the coils.

5. The snowboard binding strap assist mechanism as set forth in claim 4, wherein the helical coils of the spring define interstitial space, which are minimized in the open configuration.

6. The binding strap assist mechanism as set forth in claim 1, wherein the first lever arm has a smooth end that is hollow for receiving a reinforcement bar.

7. The binding strap assist mechanism as set forth in claim 6, wherein the reinforcement bar is made from steel.

8. The binding strap assist mechanism as set forth in claim 7, wherein the reinforcement bar is press fit into the smooth end of the first lever arm.

9. The binding strap assist mechanism as set forth in claim 1, wherein the strap support plate aligns the at least one binding strap and helps to prevent the at least one binding strap from contacting the ground when the binding strap assist mechanism maintains the open configuration.

10. The binding strap assist mechanism as set forth in claim 1, wherein the binding strap assist mechanism holds the at least one of the binding straps in an open configuration to enable a foot of a user to insert into the binding without the binding straps interfering with the foot.

11. A method of attaching a binding strap assist mechanism to a snow board binding strap comprising:

providing a binding strap having an integrated strap pad with a clasp, the strap pad being removeably attached to the binding strap with a removeably fastener;

removing the strap pad and the clasp from the binding strap;

sliding a binding strap assist mechanism over the binding strap, the binding strap assist mechanism includes a first lever arm and a second lever arm, which both include ends, the first and second lever arms being connected by a hinge, the hinge defines a spring side with a spring and a strap side that contacts a portion of the binding strap so that the ends of the lever arms are capable of biasing the binding strap in an open configuration; and replacing the strap pad and the clasp on the binding strap.

12. A method for attaching a snow board binding, comprising:

providing a snow board with a binding having a pair of binding straps, and a clasp for adjustably mating the binding straps, at least one of the binding straps have a binding strap assist mechanism to hold the at least one of the binding straps in an open configuration when the pair of binding straps are not mated;

the binding strap assist mechanism includes a strap support plate and two lever arms attached by hinge, the binding strap passes one side of the hinge, a spring mounts on another side of the hinge to bias the binding strap in the open configuration and the strap support plate limits the binding strap in the open configuration to enable a foot to enter the binding;

inserting a foot into the binding while the binding strap is in the open configuration;

securing the foot in the binding by moving the binding strap into a closed configuration and using the clasp to mate the pair of biding straps in the closed configuration.

13. The method as set forth in claim 12 wherein, the spring is a torsion spring.

14. The method as set forth in claim 12, wherein the spring compresses when the binding strap is in the closed configuration to inhibit snow from interfering with operation of the spring.

15. The method as set forth in claim 14, wherein the spring extends when the binding strap is in the open configuration to release snow from the spring.

* * * * *